US007283765B2

(12) United States Patent
Uratani et al.

(10) Patent No.: US 7,283,765 B2
(45) Date of Patent: Oct. 16, 2007

(54) DEVELOPING DEVICE, PROCESS CARTRIDGE, AND IMAGE FORMING APPARATUS HAVING DEVELOPING-ROLLER SCRAPING MEMBER

(75) Inventors: Shunsuke Uratani, Mishima (JP); Noriyuki Komatsu, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 104 days.

(21) Appl. No.: 11/234,157

(22) Filed: Sep. 26, 2005

(65) Prior Publication Data

US 2006/0067730 A1 Mar. 30, 2006

(30) Foreign Application Priority Data

Sep. 29, 2004 (JP) ..... 2004-283250
Sep. 16, 2005 (JP) ..... 2005-270710

(51) Int. Cl.
*G03G 15/08* (2006.01)

(52) U.S. Cl. ..... 399/104; 399/273

(58) Field of Classification Search ..... 399/104, 399/102, 103, 105, 273, 274, 283, 284
See application file for complete search history.

(56) References Cited

U.S. PATENT DOCUMENTS 5,790,923 A 8/1998 Oguma et al. ..... 399/106
6,205,304 B1 * 3/2001 Kawaguchi ..... 399/103
6,671,477 B2 12/2003 Komatsu et al. ..... 399/113
6,915,091 B2 * 7/2005 Matsumaru et al. ..... 399/104
7,024,131 B2 4/2006 Komatsu et al. ..... 399/109
7,110,703 B2 9/2006 Uratani et al. ..... 399/254
2004/0134070 A1 7/2004 Komatsu et al. ..... 29/895.2
2005/0232654 A1 10/2005 Karakama et al. ..... 399/109
2006/0067730 A1 3/2006 Uratani et al. ..... 399/104

FOREIGN PATENT DOCUMENTS

JP 2000089572 A * 3/2000

* cited by examiner

*Primary Examiner*—Quana Grainger
(74) *Attorney, Agent, or Firm*—Fitzpatrick, Cella, Harper & Scinto

(57) ABSTRACT

A developing device includes: a developing roller; a magnet provided in the roller and having a plurality of local maximum magnetic flux density positions on the peripheral surface of the magnet; a developing container supporting the roller; a seal member for preventing a developer from leaking out of the container; and a developer regulating member having a scraping member abutting the roller for collecting the developer on the surface of the roller toward the inside of the container in the axial direction. When viewing the developing device in the axial direction, the scraping member abuts the roller between a first position where the surface of the roller is crossed by a line which connects the supporting portion and a local maximum magnetic flux density position that is nearest to the supporting portion, and a second position where the roller develops the latent image.

14 Claims, 9 Drawing Sheets

DEVELOPING DEVICE, PROCESS CARTRIDGE, AND IMAGE FORMING APPARATUS HAVING DEVELOPING-ROLLER SCRAPING MEMBER

BACKGROUND OF THE INVENTION

1. Field of the Invention

The present invention relates to a developing device, a process cartridge, and an image forming apparatus to be used in an image formation operation of an electrophotographic printing method.

2. Related Background Art

Conventionally, in an electrophotographic image forming apparatus using the electrophotographic image forming process, there has been adopted a process cartridge system in which an electrophotographic photosensitive member as an image bearing member and a process means acting on the electrophotographic photosensitive member are integrated into a cartridge, which is detachably mountable to the electrophotographic image forming apparatus main body. In the process cartridge system, the maintenance of the apparatus can be conducted by the user without relying on a serviceman, thus achieving a substantial improvement in operability. Accordingly, the process cartridge system is widely used.

As disclosed, for example, in U.S. Pat. No. 5,790,923, in a process cartridge as described above, a photosensitive drum 1 is integrated with a process means acting thereon and composed of a charging roller 2, a developing sleeve 5, and a cleaning means.

The developing sleeve 5 carries a magnetic mono-component developer (toner) to the photosensitive drum 1, to which a developing bias is applied, thereby developing an electrostatic latent image formed on the photosensitive drum 1.

That is, the developing sleeve 5 is rotatably supported in a toner container 3. Inside the developing sleeve 5, there is provided a magnet roller 6, which is a magnet for causing the developing sleeve 5 to carry developer.

The toner is caused to adhere to the surface of the developing sleeve 5 by the magnetic force of the magnet roller 6. After the toner layer thickness has been regulated to a fixed level by a developing blade 7, the toner is conveyed to a position where it is opposed to a latent image on a photosensitive drum 10, and adheres to the latent image to thereby effect development.

In this process cartridge, seal members 13 for preventing leakage of toner to the exterior of a developing region D are provided at the ends of the developing sleeve 5.

The seal members 13 are magnetic seal members arranged with predetermined gaps between themselves and the developing sleeve 5. Concentrated magnetic fields are formed between the magnetic seal members 13 and the magnet roller 6, and toner is allowed to stay in the gaps between the seal members 13 and the developing sleeve 5, forming magnetic brushes. Due to this arrangement, leakage of toner from the toner container 3 is prevented.

However, when the developing sleeve 5 rotates, the toner tends to move outwards in the longitudinal direction of the developing sleeve 5. In view of this, a scraping member 17 is arranged in order to return the toner adhering to the longitudinal end portions of the developing sleeve 5 to the central portion with respect to the longitudinal direction again. The scraping member 17 is provided on the downstream side of the seal members 13 with respect to the rotating direction of the developing sleeve 5. A forward end portion 17a of the scraping member 17 is counter directionally in contact with the developing sleeve 5 with respect to the rotating direction of the developing sleeve 5. The forward end portion 17a is tapered so as to be capable of scraping and collecting the toner toward the longitudinal center when the developing sleeve 5 rotates.

SUMMARY OF THE INVENTION

An object of the present invention to provide a developing device, a process cartridge, and an electrophotographic image forming apparatus in which it is possible to prevent leakage of developer to the exterior of a developing container.

Another object of the present invention is to provide a developing device, a process cartridge, and an electrophotographic image forming apparatus in which it is possible to move developer effectively toward the central portion of a developing roller by means of a scraping member.

Another object of the present invention is to provide a developing device which is used for an electrophotographic image forming apparatus, the developing device including: a developing roller for developing an electrostatic latent image formed on an electrophotographic photosensitive member; a magnet provided on an inner side of the developing roller and having a plurality of local maximum magnetic flux density positions in each of which a magnetic flux density is a local maximum on a peripheral surface of the magnet; a developing container supporting the developing roller; a seal member provided at an end portion in an axial direction of the developing roller, for preventing a developer supplied to the developing roller from leaking out of the developing container in the axial direction of the developing roller; a developer regulating member for regulating an amount of developer on the peripheral surface of the developing roller, the developer regulating member having an elastic portion abutting the developing roller and a supporting portion formed of a metal material and supporting the elastic portion; and a scraping member abutting the developing roller at an end portion in the axial direction of the developing roller, for collecting the developer on the peripheral surface of the developing roller toward an inner side of the developing container in the axial direction, in which, when the developing device is seen along the axial direction of the developing roller, the scraping member abuts the developing roller between a first position where the peripheral surface of the developing roller is crossed by a line which connects, of the plurality of local maximum magnetic flux density positions, the local maximum magnetic flux density position that is nearest to the supporting portion to the supporting portion, and a second position where the developing roller develops the electrostatic latent image.

Another object of the present invention is to provide a process cartridge which is detachably mountable to an electrophotographic image forming apparatus, the process cartridge including: an electrophotographic photosensitive member; a developing roller for developing an electrostatic latent image formed on the electrophotographic photosensitive member; a magnet provided on an inner side of the developing roller and having a plurality of local maximum magnetic flux density positions in each of which a magnetic flux density is a local maximum on a peripheral surface of the magnet; a developing container supporting the developing roller; a seal member provided at an end portion in an axial direction of the developing roller, for preventing a developer supplied to the developing roller from leaking out of the developing container in the axial direction of the developing roller; a developer regulating member for regulating an amount of developer on the peripheral surface of the developing roller, the developer regulating member having an elastic portion abutting the developing roller and a supporting portion formed of a metal material and supporting the elastic portion; and a scraping member abutting the developing roller at an end portion in the axial direction of the developing roller, for collecting the developer on the peripheral surface of the developing roller toward an inner side of the developing container in the axial direction, in which, when the process cartridge is seen in the axial direction of the developing roller, the scraping member abuts the developing roller between a first position where the peripheral surface of the developing roller is crossed by a line which connects, of the plurality of local maximum magnetic flux density positions, the local maximum magnetic flux density position that is nearest to the supporting portion to the supporting portion, and a second position where the developing roller develops the electrostatic latent image.

Another object of the present invention is to provide an image forming apparatus which is used to form an image on a recording medium, the image forming apparatus including: (i) an electrophotographic photosensitive member; (ii) a developing device having: a developing roller for developing an electrostatic latent image formed on the electrophotographic photosensitive member; a magnet provided on an inner side of the developing roller and having a plurality of local maximum magnetic flux density positions in each of which a magnetic flux density is a local maximum on a peripheral surface of the magnet; a developing container supporting the developing roller; a seal member provided at an end portion in an axial direction of the developing roller, for preventing a developer supplied to the developing roller from leaking out of the developing container in the axial direction of the developing roller; a developer regulating member for regulating an amount of developer on the peripheral surface of the developing roller, the developer regulating member having an elastic portion abutting the developing roller and a supporting portion formed of a metal material and supporting the elastic portion; and a scraping member abutting the developing roller at an end portion in the axial direction of the developing roller, for collecting the developer on the peripheral surface of the developing roller toward an inner side of the developing container in the axial direction, in which, when the developing device is seen along the axial direction of the developing roller, the scraping member abuts the developing roller between a first position where the peripheral surface of the developing roller is crossed by a line which connects, of the plurality of local maximum magnetic flux density positions, the local maximum magnetic flux density position that is nearest to the supporting portion to the supporting portion, and a second position where the developing roller develops the electrostatic latent image; and (iii) a conveying means for conveying the recording medium.

Another object of the present invention is to provide an image forming apparatus to which a process cartridge is detachably mountable and which is used to form an image on a recording medium, the image forming apparatus including: (i) a mounting means for detachably mounting the process cartridge, the process cartridge comprising: an electrophotographic photosensitive member; a developing roller for developing an electrostatic latent image formed on the electrophotographic photosensitive member; a magnet provided on an inner side of the developing roller and having a plurality of local maximum magnetic flux density positions in each of which a magnetic flux density is a local maximum on a peripheral surface of the magnet; a developing container supporting the developing roller; a seal member provided at an end portion in an axial direction of the developing roller, for preventing a developer supplied to the developing roller from leaking out of the developing container in the axial direction of the developing roller; a developer regulating member for regulating an amount of developer on the peripheral surface of the developing roller, the developer regulating member having an elastic portion abutting the developing roller and a supporting portion formed of a metal material and supporting the elastic portion; and a scraping member abutting the developing roller at an end portion in the axial direction of the developing roller, for collecting the developer on the peripheral surface of the developing roller toward an inner side of the developing container in the axial direction, in which, when the process cartridge is seen along the axial direction of the developing roller, the scraping member abuts the developing roller between a first position where the peripheral surface of the developing roller is crossed by a line which connects, of the plurality of local maximum magnetic flux density positions, the local maximum magnetic flux density position that is nearest to the supporting portion to the supporting portion, and a second position where the developing roller develops the electrostatic latent image; and (ii) a conveying means for conveying the recording medium.

DESCRIPTION OF THE PREFERRED EMBODIMENTS

Figure 1:
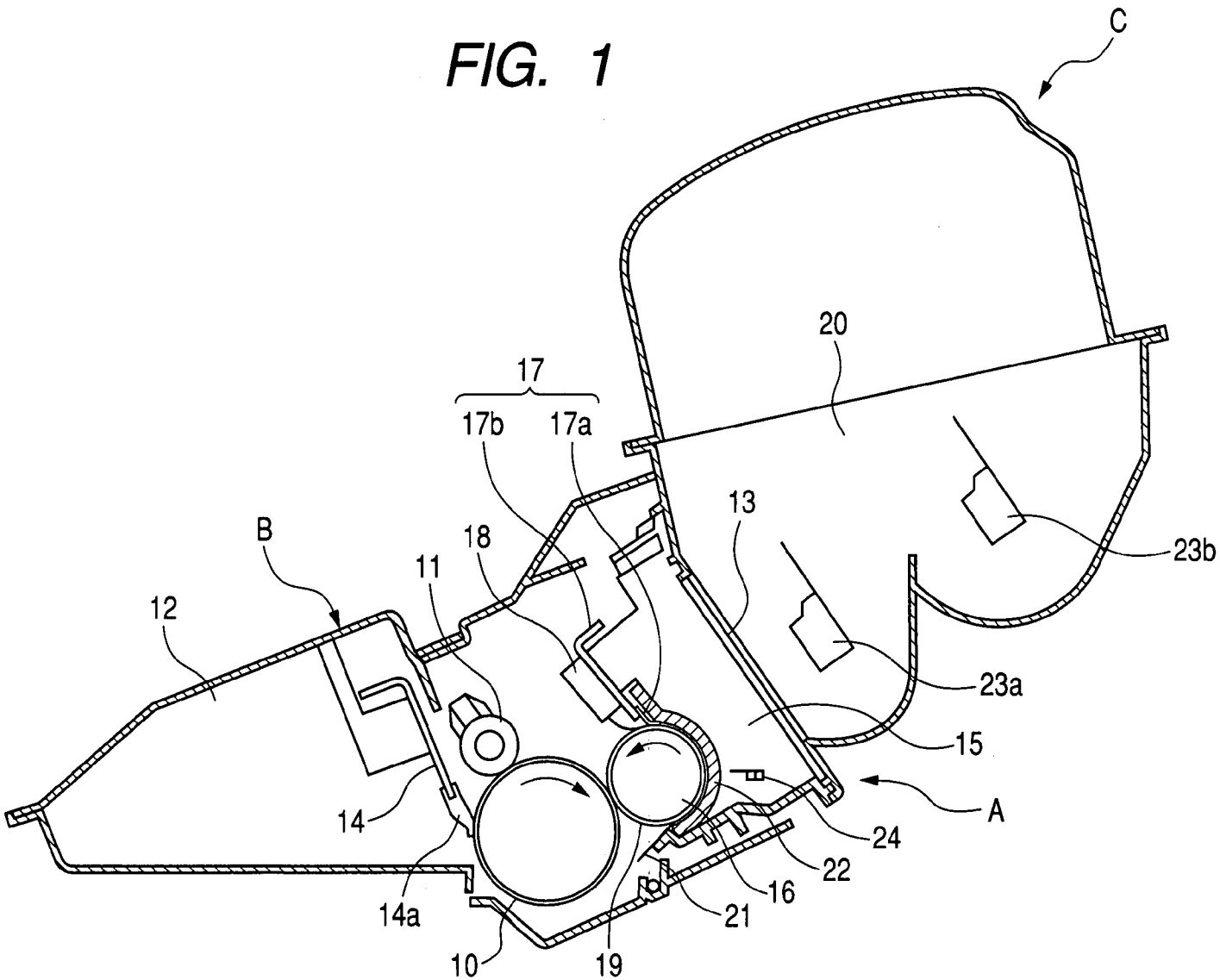
FIG. 1 is a diagram showing an example of a process cartridge according to the present invention.

In the following, a developing device, a process cartridge, and an image forming apparatus according to the present invention will be described in more detail with reference to the drawings. The reference numerals used in the description are only given for reference to the drawings and do not restrict the constructions shown in any way.

Embodiment 1

Figure 13:
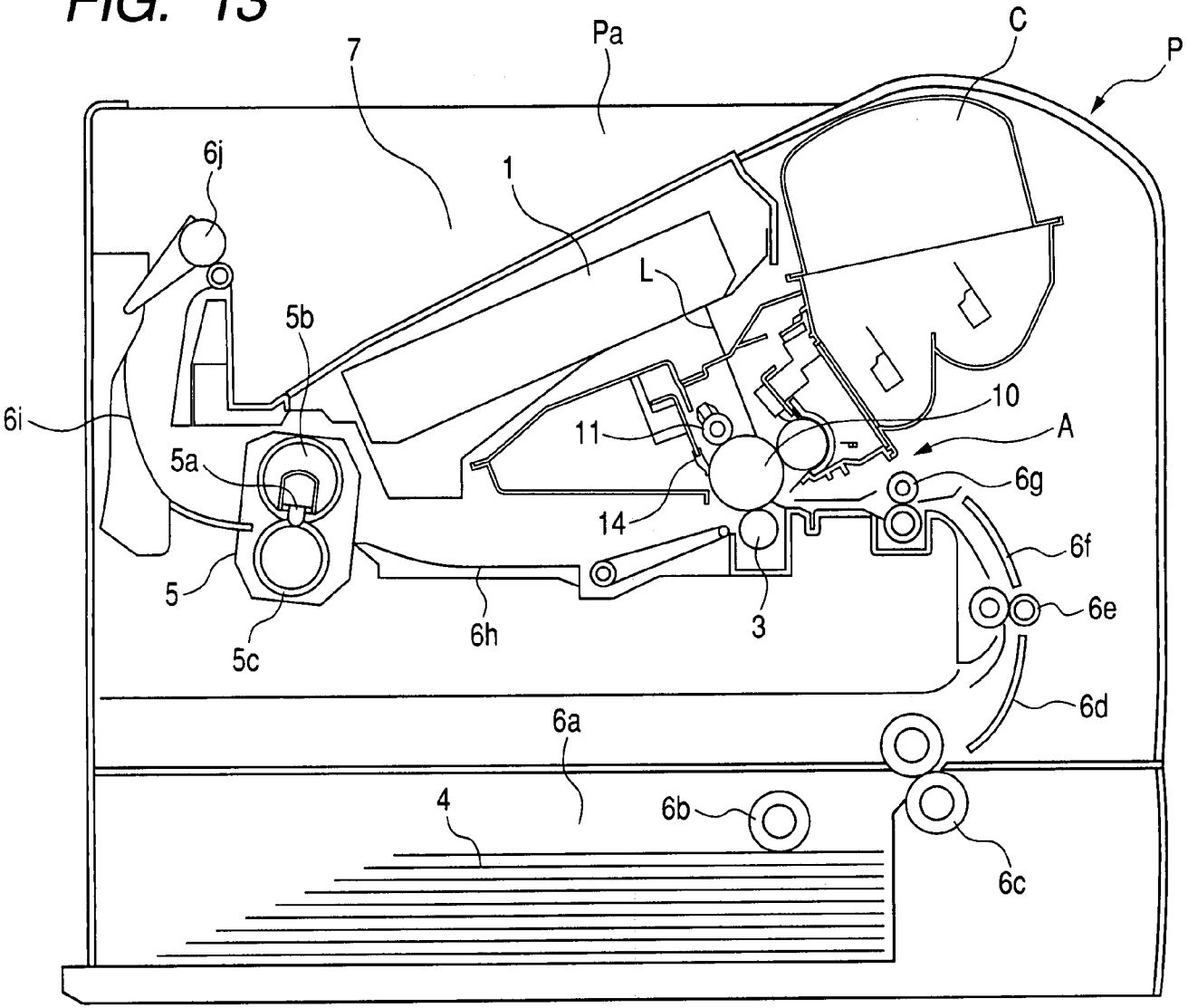
FIG. 13 is a diagram schematically showing the construction of an example of an image forming apparatus according to the present invention.

First, with reference to FIG. 13, the general construction of an image forming apparatus according to this embodiment to which a developing device A, to which the present invention is applied, is mounted, will be described. A laser beam printer P shown in FIG. 13 is an image forming apparatus, which forms an image on a recording medium 4 (e.g., a recording paper sheet, OHP sheet, or cloth) with developer (toner) by the electrophotographic image forming process.

The surface of a drum-shaped electrophotographic photosensitive member (hereinafter referred to as "photosensitive drum") 10 as the image bearing member with which the laser beam printer P is equipped, is uniformly charged by a charging roller 11 serving as a charging means. A laser beam L containing image information is applied from an optical means 1 serving as a latent image forming means (exposure means) to the peripheral surface of the photosensitive drum 10, thereby forming on the photosensitive drum 10 a latent image according to the image information. The latent image thus formed on the photosensitive drum 10 is developed by a developing means described below, thereby forming a developer image (hereinafter referred to as "toner image") on the photosensitive drum 10.

On the other hand, in synchronism with the formation of the toner image, the recording medium 4 placed in a cassette 6*a* is conveyed by a pick-up roller 6*b*, pairs of conveying rollers 6*c* and 6*e*, conveyance guides 6*d* and 6*f*, and a pair of registration rollers 6*g*.

Then, the recording medium passes a nip portion formed by the photosensitive drum 10 and a transferring roller 3, which is a transferring means to which a fixed voltage is applied. At this time, the toner image developed on the photosensitive drum 10 is transferred to the recording medium 4.

The recording medium 4 to which the toner image has been transferred is conveyed to a fixing means 5 by a conveyance guide 6*h*. The fixing means 5 has a driving roller 5*c* and a fixing roller 5*b* containing a heater 5*a*. The transferred toner image is fixed to the recording medium 4 by applying heat and pressure to the recording medium 4 passing the nip portion of the fixing means 5. Thereafter, the recording medium 4 is conveyed by a conveyance guide 6*i* and a pair of delivery rollers 6*j* before being discharged onto a delivery tray 7.

After the transfer of the toner image, residual toner on the photosensitive drum 10 is removed by a cleaning means 14, such as a blade, opposed thereto, to make the photosensitive drum 10 ready for the next image formation.

As shown in FIG. 13, in the laser beam printer P, the photosensitive drum 10, the developing device A, the charging roller 11, and the cleaning means 14 are integrated to form a process cartridge C (hereinafter referred to as "cartridge C"). The cartridge C is detachably mountable to a main body Pa of an image forming apparatus by a mounting means (not shown).

Next, the cartridge C of this embodiment will be described with reference to FIG. 1.

The developing device unit A, which is a developing means constituting the cartridge C, has a developer container (toner container) 20, a developing roller 19, and a developing blade 17. The toner container 20 accommodates a magnetic mono-component developer (toner), which serves as the developer. The developing roller 19 is formed as a hollow cylinder for supplying toner to an electrostatic latent image formed on the peripheral surface of the photosensitive drum 10 to form a visible image. The developing blade 17 imparts a triboelectrification charge to the toner and forms a toner layer on the surface of the developing roller 19.

The developing roller 19 is provided in a developing container 15. The developing container 15 is connected to the toner container 20, and a toner seal 13, which is a sealing member, is provided between the toner container 20 and the developing container 15. Prior to the use of the developing device A, toner is accommodated in the toner container 20, and leakage of toner from the toner container 20 is prevented by the toner seal 13. When using the cartridge C, the user first pulls out the toner seal 13. When the toner seal 13 has been pulled out, the toner that has been accommodated in the toner container 20 flows into the developing container 15.

At a lower opening between the developing roller 19 and the developing container 15, there is provided a blow-out preventing sheet 21, preventing leakage of toner through the lower opening.

When performing a developing operation, the toner in the toner container 20 is supplied to the developing roller 19 through rotation of agitating means 23*a* and 23*b*. The developing roller 19 contains a magnet roller 16 provided in a stationary position with respect to its rotation. The magnetic pole arrangement of the magnet roller 16 will be described in detail below.

Further, installed in the developing container 15 is a developing blade 17 composed of a blade 17*a* in contact with the peripheral surface of the developing roller 19 and consisting of an elastic member (elastic portion), and a supporting portion 17*b* supporting the blade 17*a* and being magnetic. At the contact portion between the developing blade 17 and the developing roller 19, a triboelectrification charge is imparted from the blade 17*a* to the toner carried on the surface of the developing roller 19, and the thickness of the toner layer on the surface of the developing roller 19 is regulated.

The developing roller 19 is pressed against the photosensitive drum 10 by an urging spring (not shown) while maintaining a fixed clearance between itself and the photosensitive drum 10 by a spacer runner (not shown). The developing roller 19 supplies the toner layer formed on the surface thereof to the developing region D of the photosensitive drum 10 to develop the electrostatic latent image. Further, in the vicinity of the developing roller 19, there is rotatably mounted a developer agitating member 24 for circulating the toner in the developing container 15.

A photosensitive member unit B, which constitutes the cartridge C, is equipped with the photosensitive drum 10, the charging roller 11, and the cleaning blade 14. The charging roller 11 serves to uniformly charge the surface of the photosensitive drum 10. The cleaning blade 14 serves to scrape off from the surface of the photosensitive drum 10 residual toner adhering to the photosensitive drum 10 without being transferred to the recording medium 4.

The photosensitive drum 10 rotates clockwise. A fixed voltage is applied to the charging roller 11, and when the photosensitive drum 10 comes into contact with it, the surface of the photosensitive layer of the photosensitive drum 10 is uniformly charged. Then, a laser beam L according to image information from the optical means 1 is applied to the photosensitive drum 10, thereby forming an electrostatic latent image. Thereafter, a developer image (toner image) is formed on the photosensitive drum 10 by the developing device A constructed as described above, which constitutes the developing means.

A voltage of a polarity opposite to that of the toner image is applied to the transferring roller 3 provided in the main body Pa of the laser beam printer (FIG. 13) to transfer the toner image formed on the photosensitive drum 10 to the recording medium 4. Thereafter, the residual toner on the photosensitive drum 10 is removed by the cleaning blade 14. Here, the cleaning blade 14, which is in contact with the photosensitive drum 10, scrapes off the toner remaining on the photosensitive drum 10 and collects it in a waste toner container 12.

The features of the present invention as embodied in this embodiment in the laser beam printer P, constituting the image forming apparatus, and the cartridge C described above, will be illustrated with reference to FIGS. 2 through 8.

Figure 2:
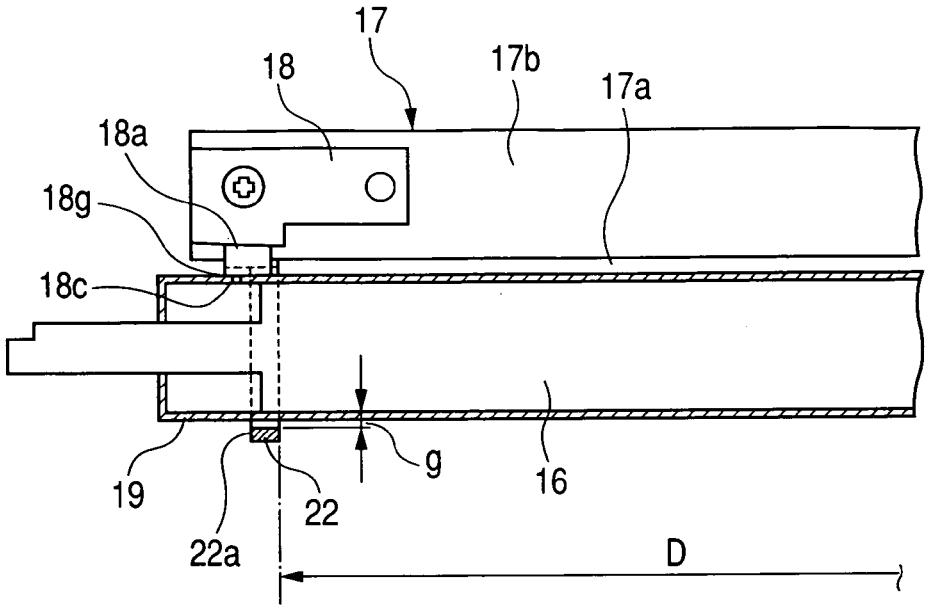
FIG. 2 is a partial sectional view of an axial end portion of a developer carrying member in an example of a developing device according to the present invention.

FIG. 2 is an explanatory axial (longitudinal) sectional view of an end portion of the developing roller 19, consisting of a hollow cylinder, in the developing device A. The interior of the developing roller 19 contains the magnet roller 16 which is a bar-shaped magnet and which is kept stationary in a predetermined position even while the developing roller 19 is rotated. Further, on the surface of the developing roller 19, there is arranged the developing blade 17, composed of the blade 17*a* consisting of an elastic member for regulating the toner layer thickness and the supporting portion (supporting member) 17*b*, so as to be held in contact with the surface of the developing roller 19 with a predetermined pressure. Here, the supporting portion 17*b* is formed, for example, of a metal material, such as cold-rolled carbon steel.

Further, arranged in the axial end region of the developing roller 19 are a magnetic seal member 22, which is a ferromagnetic member provided along the peripheral surface of the developing roller 19, and a developer scraping member (scraper) 18 whose end edge portion is in contact with the developing roller 19.

The magnetic seal member 22 serves to prevent toner from leaking to the exterior of the developing container 15 through the gap between it and the developing roller 19. Further, the scraper 18 has, on the outer side of an outer end portion 22*a* of the magnetic seal member 22 in the axial direction of the developing roller 19, a contact point end portion 18*g*, which adheres to the surface of the developing roller 19. The scraper 18 serves to return the toner allowed to leak through the gap between the magnetic seal member 22 and the developing roller 19 as a result of rotation of the developing roller 19 to the developing region D side (the central side with respect to the longitudinal direction). Here, the scraper 18 is mounted to the outer side surface of the supporting member 17*b* of the developing blade 17 with respect to the developing container 15. The scraper 18 is formed of polyacetal (POM), polycarbonate, or the like, which has a slidability property.

Figure 3:
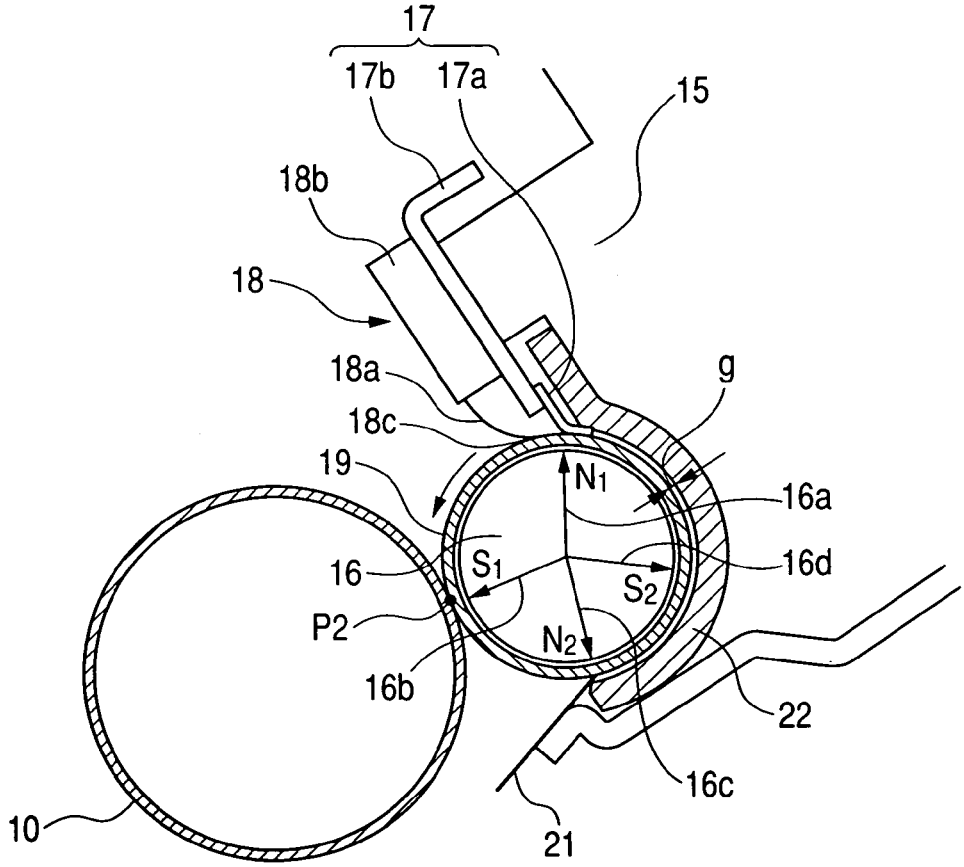
FIG. 3 is a partial sectional view of an axial end portion of a developer carrying member in an example of a developing device according to the present invention.

FIG. 3 is a sectional view showing the axial (longitudinal) end region of the developing roller 19. In FIG. 3, the magnetic seal member 22 is arranged at the axial ends of the developing roller 19 and inside the developing container 15, with a predetermined gap g being left between the outer peripheral surface of the developing roller 19 and itself. Concentrated magnetic fields are formed between the magnetic seal member 22 and the magnet roller 16 provided inside the developing roller 19. Toner is allowed to exist in the gap portions between the magnetic seal member 22 and the developing roller 19 to form magnetic brushes, thereby preventing the toner in the developing container 15 from leaking to the exterior from the developing container 15 through these gap portions.

In this embodiment, the magnetic seal members 22 are formed of a magnet generating a magnetic field. They are provided at the end portions of the developing roller 19 so as to extend along the peripheral surface thereof, and, in this state, are mounted to the developing container 15 together with the developing roller 19.

Figure 4A:
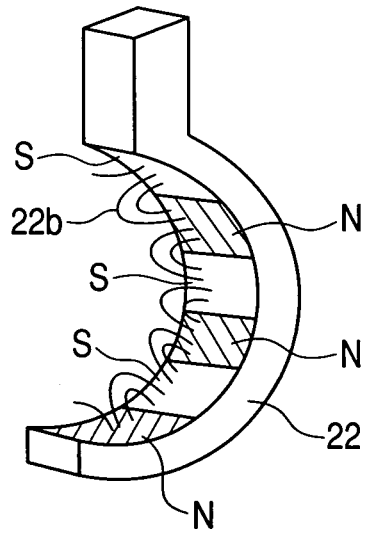
FIGS. 4A, 4B, and 4C are perspective views of an example of a seal member according to the present invention.

As shown, for example, in FIG. 4A, the inner surface of the magnetic seal member 22 is magnetized such that N-poles and S-poles are arranged alternately. The gap g between the outer peripheral surface of the developing roller 19 and the surface of the magnetic seal member 22 is filled with a magnetic brush of a toner that stands like the ears of rice formed along magnetic lines of force 22*b*, preventing toner from flowing out of the developing region D. The construction of the magnetic seal member 22 is not particularly restricted to the one described above.

Figure 4B:
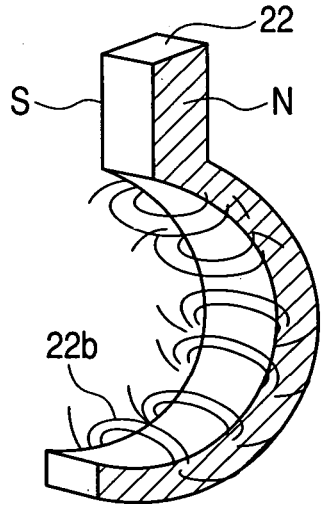
Figure 4C:
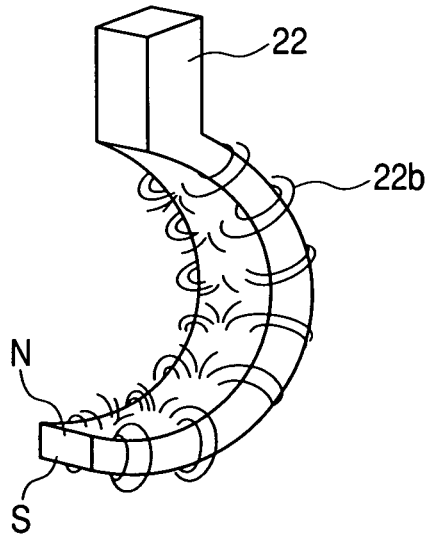

As shown in FIGS. 4B and 4C, it is also possible to adopt a magnetic seal member 22 whose side surfaces are respectively magnetized to—and S-poles, or a magnetic seal member 22 whose front and back surfaces are respectively magnetized to—and S-poles.

By using such a magnetic seal member 22, the developing roller 19 and the magnetic seal member 22 can be maintained in a non-contact state, and the requisite torque for the developing roller 19 is markedly reduced. Thus, it is possible to use a small and inexpensive motor as the driving motor for the developing roller 19. Further, fluctuation in the rotation torque only occurs to a small degree, and unevenness in the rotation of the developing roller 19 and the photosensitive drum 10 is not easily generated. Further, the magnetic seal member 22 is free from wear, etc., so that it can exhibit a satisfactory sealing property semi-permanently. Further, the magnetic seal member allows recycling.

Here, the scraper 18, which is formed by mounting a forward end portion 18*a* to a scraper supporting member 18*b* as in the conventional art, has the following features (1) through (3):

(1) In FIG. 3, the scraper 18 is on the downstream side of the magnetic seal member 22 with respect to the rotating direction of the developing roller 19, which rotates counterclockwise.

(2) The forward end portion 18*a* of the scraper 18 is counter directionally in contact with the surface of the developing roller 19 with respect to the rotating direction of the developing roller 19.

Figure 5:
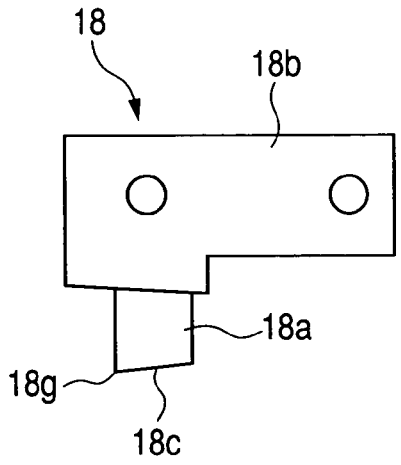
FIG. 5 is a front view of an example of a developer scraping member according to the present invention.

(3) As shown in FIG. 5, an end edge portion 18*c* of the forward end portion 18*a* of the scraper 18 is tapered so that, when the developing roller 19 rotates, the toner adhering to the surface of the developing roller 19 may be scraped and collected toward the developing region D (toward the longitudinal center).

Due to the above features (1), (2), and (3), the scraper 18 scrapes and collects toner toward the developing region D in the longitudinal direction of the developing roller 19 before the toner reaches a developing portion (hereinafter referred to as "second position") P2 (see FIG. 3) between the developing roller 19 and the photosensitive drum 10. The toner referred to here is the toner which adheres to the surface of the developing roller 19 and comes out of the gap portion between the magnetic seal member 22 and the developing roller 19 at the outlet of the developing container 15 as a result of the rotation of the developing roller 19.

Figure 6:
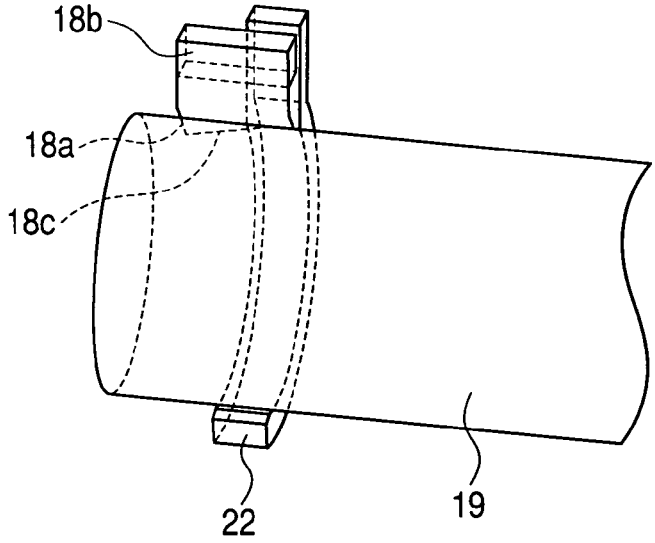
FIG. 6 is a partial perspective view of an example of an axial end portion of a developer carrying member according to the present invention and a portion around the same.

Further, as shown in FIG. 6, in this embodiment, the end edge 18*c* is tapered such that it abuts the developing roller 19 gradually on the downstream side with respect to the rotating direction of the developing roller 19 as it extends toward the developing region D (toward the longitudinal center of the developing roller 19). Thus, the toner scraped off is collected toward the developing region D (toward the longitudinal center) by the rotation of the developing roller 19. Due to the above-described construction, the scraper 18 is improved in its scraping/collecting capacity.

Further, in this embodiment, a magnetic circuit is generated between the magnetic force of the magnet roller 16 and the supporting portion 17*b* of the developing blade 17. In order that the collected toner may be prevented from being deposited at the portion where the scraper 18 abuts the developing roller 19, the scraper 18 is constructed as follows.

Figure 7:
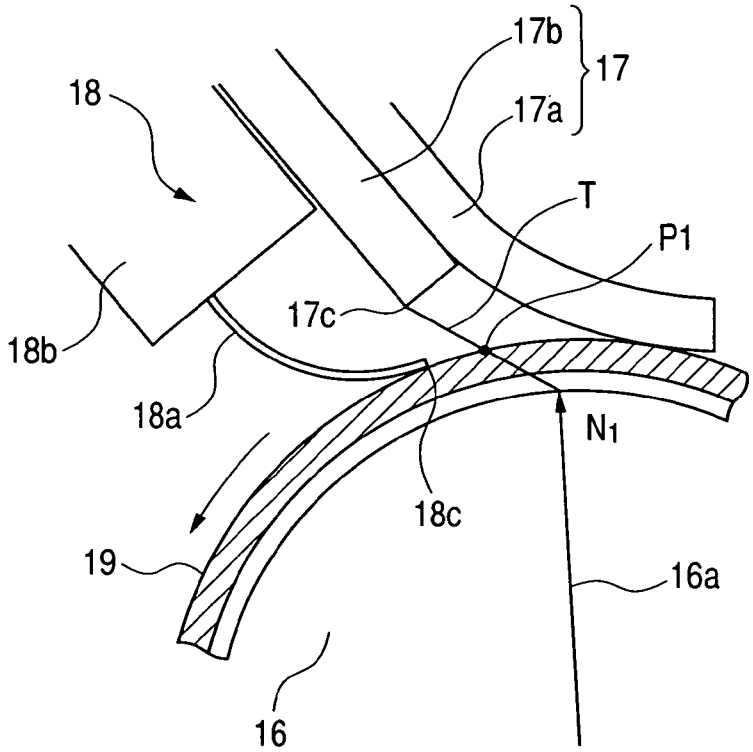
FIG. 7 is an enlarged sectional view of an example of a portion where a developer carrying member and a developer scraping member according to the present invention are in contact with each other and portions around the same.

As shown in FIG. 7, the scraper 18 is characterized in that the end edge portion 18*c* of the forward end portion 18*a* thereof abuts the surface of the developing roller 19 on the downstream side of a magnetic circuit T with respect to the rotating direction of the developing roller 19. The magnetic circuit T is one formed between the point (indicated at 17*c*) of the supporting portion 17*b* of the developing blade 17 which is nearest to the peripheral surface of the developing roller 19 and an N1 pole 16*a* of the magnet roller 16.

Here, the magnetic circuit T will be described.

Figure 8:
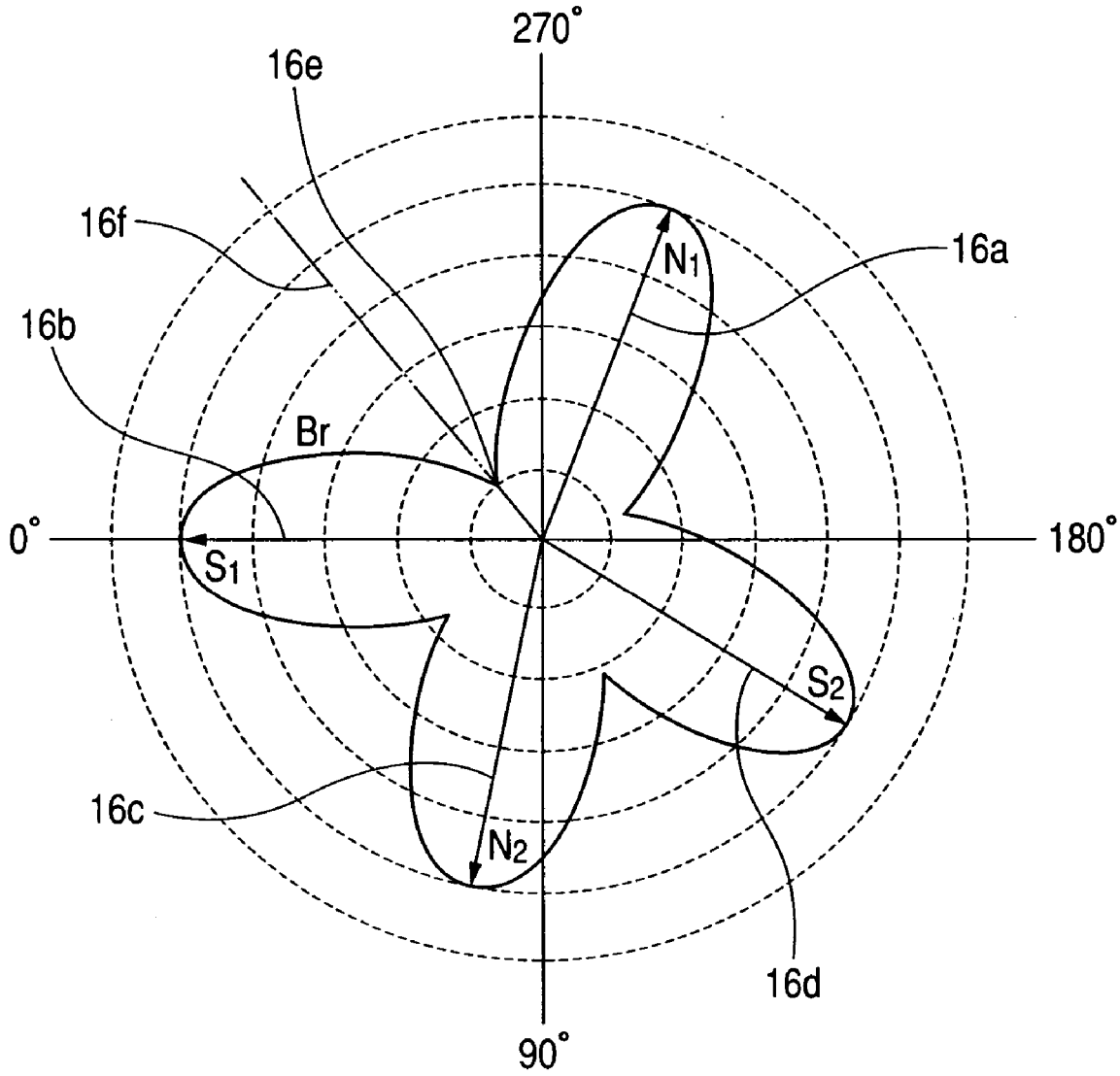
FIG. 8 is an explanatory view of an example of the magnetic pole arrangement of a developing magnetic field generating member according to the present invention.

FIG. 8 shows the magnetic flux density distribution formed by the magnet roller 16. In section, the magnet roller 16 has four magnetic poles (N-pole N1, S-pole S1, N-pole N2, and S-pole S2) in its outer periphery. In FIG. 8, their local maximum magnetic flux density directions are indicated by the arrows 16*a*, 16*b*, 16*c*, and 16*d*, respectively.

In the partial sectional view of FIG. 3, which shows the portion of the developing device A where the developing roller 19 is arranged, of the local maximum magnetic flux density directions of the four magnetic poles shown in FIG. 8, the local maximum magnetic flux density direction 16*a* of the magnetic pole N1 is pointed at the developing blade 17. That is, when the developing roller 19 is seen along the axial direction thereof, of the four maximum magnetic poles, the N1-pole whose maximum magnetic flux density is in the direction 16*a* is the magnetic pole that is the nearest to the supporting portion 17*b* of the developing blade 17. Further, the local maximum magnetic flux density direction 16*b* of the magnetic pole S1 is pointed at a region in the vicinity of the portion where the photosensitive drum 10 and the developing roller 19 are closest to each other. The local maximum magnetic flux density direction 16*c* of the magnetic pole N2 is pointed at the opening side edge portion of the developing container 15. Further, the local maximum magnetic flux density direction 16*d* of the magnetic pole S2 is pointed at the interior of the developing container 15.

In FIG. 8, the curves in solid lines indicate the radial distribution of the density of the magnetic flux in the developing roller 19 generated by the magnetic poles of the magnet roller 16, and this magnetic flux density distribution is indicated by symbol Br. Here, the region connecting the center of the photosensitive drum 10 and the center of the developing roller 19 is assumed as an abscissa axis, with the portion opposed to the photosensitive drum 10 being at an angle of 0°.

The measurement of the magnetic flux density distribution Br shown in FIG. 8 is conducted by fixing in position a probe using a Hall device (SAF71-1802-15 manufactured by F. W. BELL) in the vicinity of the magnet roller 16. That is, the distribution is obtained through measurement by a gauss meter (Type 7030 manufactured by F. W. BELL) while rotating the magnet roller 16. The S- and N-poles may be reversed. Further, while this embodiment employs a permanent magnet, it is also possible to use an electromagnet.

As shown in FIG. 7, the magnetic circuit T is in a region connecting the local maximum magnetic flux density position of the magnetic pole N1 of the magnet roller 16 where developer is regulated by the developing blade 17, and the supporting portion 17*b*; in a sectional view of the developing roller 19 as seen along the axial direction, it is represented as linear. Further, in the above-mentioned sectional view, the end edge portion 18*c* of the forward end portion 18*a* of the scraper 18 abuts the peripheral surface of the developing roller 19 on the downstream side of the magnetic circuit T with respect to the rotating direction of the developing roller 19. That is, the scraper 18 abuts the developing roller 19 between a first position P1 where the magnetic circuit T crosses the peripheral surface of the developing roller 19 and a second position P2 (see FIG. 3) where the developing roller 19 develops an electrostatic latent image.

As a result of the rotation of the developing roller 19, toner leaks through the gap portion between the magnetic seal member 22 and the developing roller 19, and passes the magnetic circuit T before reaching the position where the forward end portion 18*a* of the scraper abuts the developing roller 19. Then, the toner is completely scraped and collected from the surface of the developing roller 19 toward the developing region D (toward the longitudinal center) by the end edge portion 18*c* of the scraper forward end portion 18*a*.

As stated above, the forward end portion 18*a* of the scraper is situated on the downstream side of the magnetic circuit T with respect to the rotating direction of the developing roller 19. Thus, the position at which the end edge portion 18*c* of the scraper forward end portion 18*a* abuts the developing roller 19 is spaced apart from the magnetic circuit T. Accordingly, the binding force due to the magnetic force of the magnetic circuit T exerted on the toner that has reached the scraper forward end portion 18*a* is small. Thus, due to the tapered configuration of the scraper forward end portion 18*a*, it is possible to efficiently scrape and collect the toner toward the developing region D (toward the longitudinal center) as the developing roller 19 rotates.

That is, the scraper 18 abuts the developing roller 19 between the first position P1, where the magnetic circuit T crosses the peripheral surface of the developing roller 19, and the second position P2 (see FIG. 3), where the developing roller 19 develops the electrostatic latent image on the peripheral surface of the photosensitive drum 10. Due to this arrangement, the developer is scraped and collected by the scraper 18 at a position spaced apart from the magnetic circuit T, so that it is possible to efficiently scrape and collect the developer that has been leaked, making it possible to efficiently return the developer to the developing region D. Further, it is possible to prevent leakage of developer from the developing device A. For, in the region where scraping and collecting are effected by the scraper 18, the binding force due to the magnetic force of the magnetic circuit is small, and no developer is deposited there.

Figure 14:
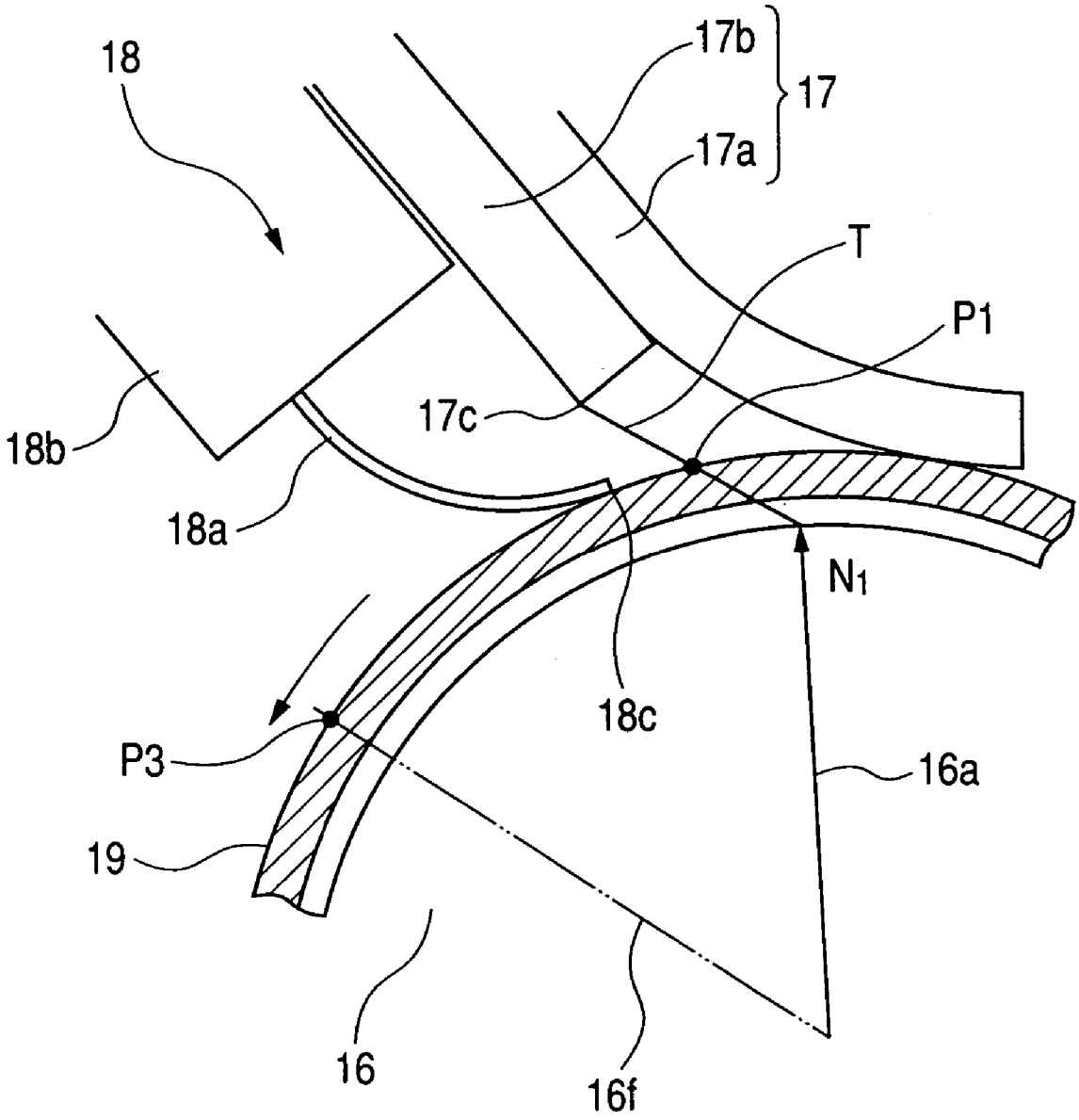
FIG. 14 is an enlarged sectional view of yet another example of a portion where a developer carrying member and a developer scraping member according to the present invention are in contact with each other and portions around the same.

Here, the region on the downstream side of the magnetic circuit T with respect to the rotating direction of the developing roller 19, is generally in the range extending from the position P1 to the position P2 along the rotating direction of the developing roller 19. Further, it may also be in the range up to the position on the circumference of the developing roller 19 of a point 16*e* where the magnetic flux density of the N1-pole, which is the developer regulating magnetic pole, in the magnetic flux density distribution formed by the magnet roller 16, shown in FIG. 8, is a minimum. That is, as shown in FIGS. 8 and 14, the scraper 18 abuts the developing roller 19 between the first position P1 and a third position P3 where a line 16*f* connecting the center of the developing roller and the local maximum magnetic flux density position 16*e* crosses the peripheral surface of the developing roller. The third position P3 is situated between the first position P1 and the second position P2. The third position P3 is a position where the influence of the magnetic force of the magnet roller 16 is small. Thus, by causing the scraper 18 to abut the developing roller 19 between the third position P3 and the first position P1, it is possible to scrape and collect the toner still more efficiently toward the developing region D (toward the longitudinal center). Further, the toner having leaked through the gap portion between the magnetic seal member 22 and the developing roller 19 can be scraped and collected efficiently at an early stage toward the developing region D (toward the longitudinal center), so that it is possible to develop the electrostatic latent image at the first position P1 in a stable manner.

In the embodiment described above, the magnetic seal member 22 is used as the seal member for preventing leakage of toner to the exterior of the developing container in the longitudinal direction of the developing roller 19. However, it is also possible to use a seal member formed of a non-woven fabric which comes into contact with the peripheral surface of the developing roller 19 to prevent toner leakage.

Embodiment 2

Next, Embodiment 2 of the present invention will be described with reference to FIGS. 9 through 12. In the drawings, the components which are common to Embodiment 1 are indicated by the same reference numerals, and a description thereof will be omitted. In this embodiment, the position at which the scraper forward end portion 18*a* abuts the developing roller 19 is the same as that in Embodiment 1. That is, the scraper 18 abuts the developing roller 19 between the position P1, where the magnetic circuit T crosses the peripheral surface of the developing roller 19, and the second position P2, where the developing roller 19 develops the electrostatic latent image on the peripheral surface of the photosensitive drum 10.

Figure 9:
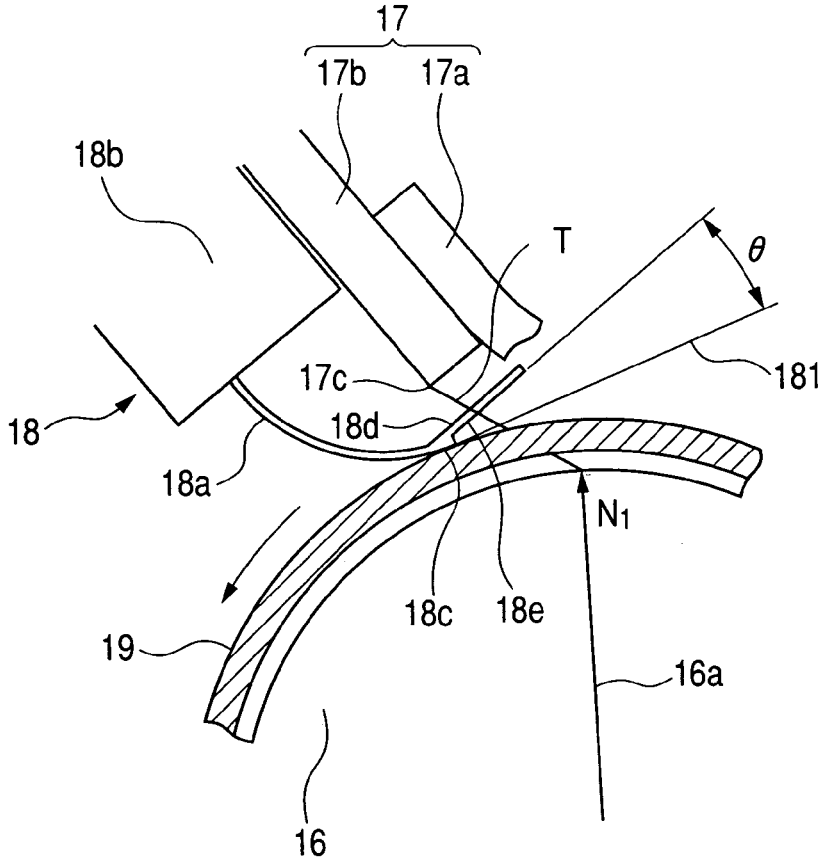
FIG. 9 is an enlarged sectional view of another example of a portion where a developer carrying member and a developer scraping member according to the present invention are in contact with each other and portions around the same.

As shown in FIG. 9, in this embodiment, the developing device A, which is of the same construction as that in Embodiment 1, is provided with a spatter preventing portion 18*d* for preventing the toner collected by the scraper 18 from fuming up (being spattered) from the surface of the developing roller 19. The spatter preventing portion 18*d* extends from the forward end portion 18*a* of the scraper 18, and is provided integrally with the scraper 18.

The spatter preventing portion 18*d* is installed such that the angle made by the developing roller 19 side surface 18*e* of the spatter preventing portion 18*d* and a tangent 181 at the position where the scraper 18 abuts the developing roller 19 is an acute angle ?. That is, the spatter preventing portion 18*d* is installed so as to extend from the abutment portion 18*c* of the scraper 18 and to be spaced apart from the surface of the developing roller 19 by the angle ?. Due to the above construction, if the toner scraped off by the scraper 18 leaves the surface of the developing roller 19 and fumes up around the end edge portion 18*c*, the spatter preventing portion 18*d* of the scraper 18 serves as a barrier to suppress the fuming up of the toner.

As a result of toner ceasing to fume up, the amount of toner attracted by the magnetic force of the magnetic circuit T between the N1-pole 16*a* of the magnet roller 16 and the supporting member 17*b* of the developing blade 17 is reduced. Further, it is possible to reduce the amount of toner bound by the magnetic force of the magnetic circuit T between the N1-pole 16*a* of the magnet roller 16 and the supporting member 17*b* of the developing blade 17.

Thus, due to the provision of the spatter preventing portion 18*d* of the scraper 18, the amount of toner to be collected toward the developing region D is reduced, and it is possible to scrape and collect toner still more efficiently toward the developing region D (toward the longitudinal center of the developing roller 19).

Figure 10:
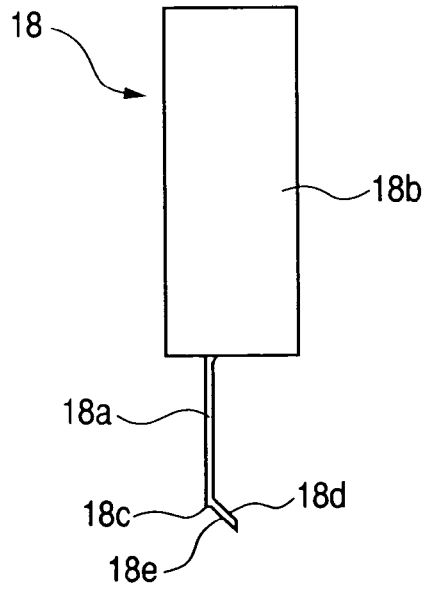
FIG. 10 is a sectional view of another example of a developer scraping member according to the present invention.
Figure 11:
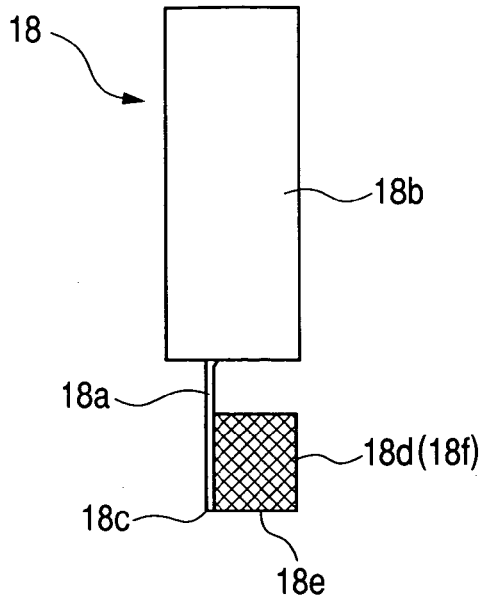
FIG. 11 is a sectional view of still another example of a developer scraping member according to the present invention.
Figure 12:
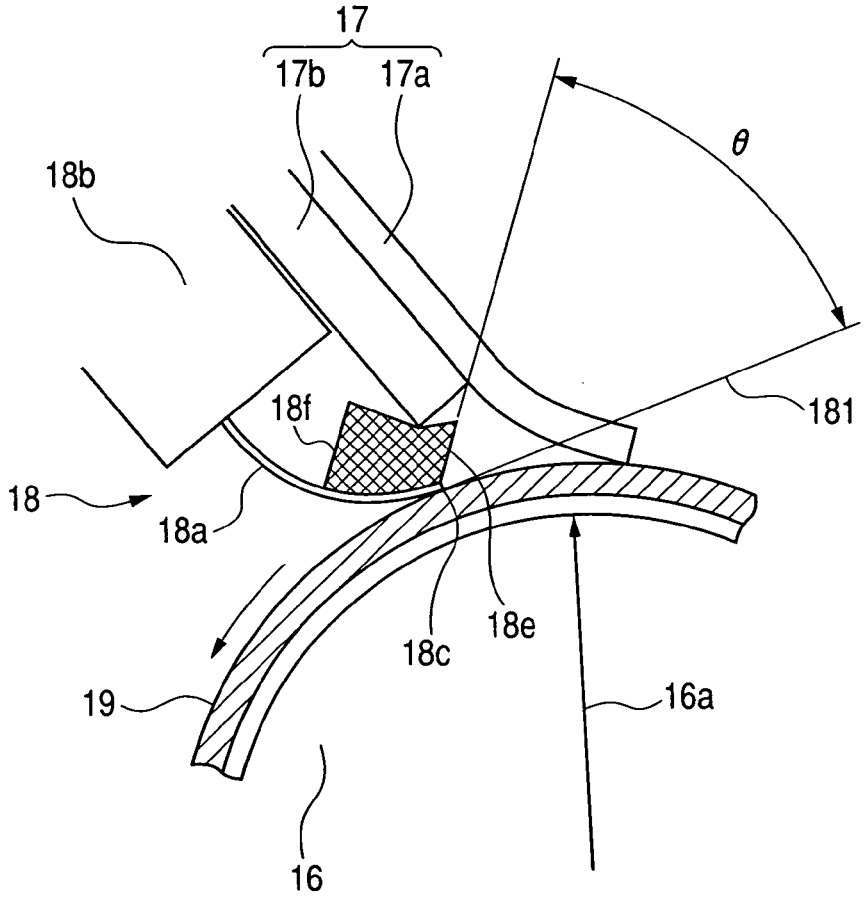
FIG. 12 is an enlarged sectional view of still another example of a portion where a developer carrying member and a developer scraping member according to the present invention are in contact with each other and portions around the same.

While in this example the spatter preventing portion 18*d* extends from the end edge portion 18*c* of the forward end portion 18*a* of the scraper 18 and is formed integrally therewith as shown in FIG. 10, this should not be construed restrictively. For example, as shown in FIG. 11, the spatter preventing portion 18*d* of the scraper 18 may consist of a spatter preventing member 18*f* formed of foam urethane or the like. That is, the spatter preventing member 18*f* is integrally superimposed on the back surface of the portion of the scraper forward end portion 18*a* abutting the developing roller 19, and, as shown in FIG. 12, is arranged such that the angle ? made by the developing roller 19 side surface 18*e* of the spatter preventing member 18*f* and the tangent 181 is an acute angle. The tangent 181 is the tangent with respect to the developing roller 19 at the position where the scraper 18 abuts the developing roller 19. This construction helps to obtain the same effect as that described above.

As described above, in this embodiment, it is possible to scrape and collect developer at a position spaced apart from the magnetic circuit formed by the magnetic force of the magnet roller and the supporting portion of the developer regulating member. Thus, the binding force due to the magnetic force of the magnetic circuit formed between the developer regulating member and the magnet roller is exerted on the scraping/collecting portion of the scraper only to a small degree. Thus, it is possible to efficiently scrape and collect developer efficiently into the developing region D, and to prevent leakage of developer from the developing device.

Further, there is provided the spatter preventing portion for suppressing fuming up of the developer scraped and collected by the scraper from the surface of the developing roller. Further, the angle made by the tangent at the position where the scraper abuts the developing roller and the developer carrying member side surface of the spatter preventing portion is an acute angle.

Due to this construction, it is possible to regulate the amount of developer accumulated on the scraper, so that the amount of developer bound by the magnetic force of the magnetic circuit formed by the magnetic force of the developing magnetic field generating member and the supporting portion of the developer regulating member, is reduced. Further, it is possible to reliably scrape and collect developer toward the developing region D.

The sizes, materials, and configurations of the components of the image forming apparatus described above, and the positional relationship of the components, are not restricted to the above-described ones unless otherwise specified.

For example, the construction of the image forming apparatus may be other than that shown in FIG. 13. It may also be one having a plurality of photosensitive drums, or one adopting the intermediate transfer system. Further, there are no particular limitations regarding the construction of the process cartridge; any type of process cartridge will do as long as it is equipped with an image bearing member, on the surface of which an electrostatic latent image is formed, and a developing device; it may be one equipped with no cleaning blade or charging roller. Further, in the image forming apparatus, it is not always necessary to use a process cartridge formed as an integral unit. As the developer, apart from the magnetic mono-component toner, which is a magnetic powder, as used in Embodiments 1 and 2, the present invention is also applicable to an apparatus using some other type of developer, such as a two-component developer containing magnetic powder.

According to the present invention, it is possible to effectively prevent leakage of developer to the exterior of the developing container. Further, due to the scraping member, it is possible to move developer effectively toward the center of the developing roller.

This application claims priority from Japanese Patent Application Nos. 2004-283250 filed Sep. 29, 2004 and 2005-270710 filed Sep. 16, 2005, which are hereby incorporated by reference herein.

What is claimed is:

1. A developing device for an electrophotographic image forming apparatus, the developing device comprising:

a developing roller configured and positioned to develop an electrostatic latent image formed on an electrophotographic photosensitive member;

a magnet provided on an inner side of said developing roller and having a plurality of local maximum magnetic flux density positions in each of which a magnetic flux density is a local maximum on a peripheral surface of said magnet;

a developing container supporting said developing roller;

a seal member provided at an end portion in an axial direction of said developing roller, configured and positioned to prevent a developer supplied to said developing roller from leaking out of said developing container in the axial direction of said developing roller;

a developer regulating member configured and positioned to regulate an amount of developer on the peripheral surface of said developing roller, said developer regulating member having an elastic portion abutting said developing roller and a supporting portion formed of a metal material and supporting said elastic portion; and a scraping member abutting said developing roller at an end portion in the axial direction of said developing roller, configured and positioned to collect the developer on the peripheral surface of said developing roller toward an inner side of said developing container in the axial direction, wherein, when said developing device is seen along the axial direction of said developing roller, said scraping member abuts said developing roller between a first position where the peripheral surface of said developing roller is crossed by a line which connects the supporting portion to the local maximum magnetic flux density position of the plurality of local maximum magnetic flux density positions that is nearest to said supporting portion, and a third position which is between the first position and a second position where said developing roller develops the electrostatic latent image and at which a line connecting a center of said developing roller and a local minimum magnetic flux density position crosses the peripheral surface of said developing roller, the local minimum magnetic flux density position being a position where the magnetic flux density is a minimum on the peripheral surface of said magnet.

2. A developing device according to claim 1, wherein said scraping member is attached to said supporting portion.

3. A developing device according to claim 1, wherein said seal member is a magnetic seal member configured and positioned to generate a magnetic field, said magnetic seal member being arranged at a predetermined distance from the peripheral surface of said developing roller, and wherein the magnetic field prevents said developer supplied to said developing roller from leaking out of said developing container.

4. A developing device according to claim 1, wherein, in the axial direction of said developing roller, an outer end portion of said scraping member is arranged on an outer side of an outer end portion of said seal member.

5. A developing device according to claim 1, wherein said scraping member has a spatter preventing portion configured and positioned to suppress spattering of developer from the peripheral surface of said developing roller.

6. A developing device according to claim 5, wherein an angle made by a tangent at a position where said scraping member abuts said developing roller and said spatter preventing portion is an acute angle.

7. A process cartridge which is detachably mountable to an electrophotographic image forming apparatus, the process cartridge comprising:

an electrophotographic photosensitive member;

a developing roller configured and positioned to develop an electrostatic latent image formed on said electrophotographic photosensitive member;

a magnet provided on an inner side of said developing roller and having a plurality of local maximum magnetic flux density positions in each of which a magnetic flux density is a local maximum on a peripheral surface of said magnet;

a developing container supporting said developing roller;

a seal member provided at an end portion in an axial direction of said developing roller, configured and positioned to prevent a developer supplied to said developing roller from leaking out of said developing container in the axial direction of said developing roller;

a developer regulating member configured and positioned to regulate an amount of developer on the peripheral surface of said developing roller, said developer regulating member having an elastic portion abutting said developing roller and a supporting portion formed of a metal material and supporting said elastic portion; and a scraping member abutting said developing roller at an end portion in the axial direction of said developing roller, configured and positioned to collect the developer on the peripheral surface of said developing roller toward an inner side of said developing container in the axial direction, wherein, when said process cartridge is seen along the axial direction of said developing roller, said scraping member abuts said developing roller between a first position where the peripheral surface of the developing roller is crossed by a line which connects said supporting portion to the local maximum magnetic flux density position of the plurality of local maximum magnetic flux density positions that is nearest to said supporting portion, and a third position which is between the first position and a second position where said developing roller develops the electrostatic latent image and at which a line connecting a center of said developing roller and a local minimum magnetic flux density position crosses the peripheral surface of said developing roller, the local minimum magnetic flux density position being a position where the magnetic flux density is a minimum on the peripheral surface of said magnet.

8. A process cartridge according to claim 7, wherein said scraping member is attached to said supporting portion.

9. A process cartridge according to claim 7, wherein said seal member is a magnetic seal member configured and positioned to generate a magnetic field, said magnetic seal member being arranged at a predetermined distance from the peripheral surface of said developing roller, and wherein the magnetic field prevents the developer supplied to said developing roller from leaking out of said developing container.

10. A process cartridge according to claim 7, wherein, in the axial direction of said developing roller, an outer end portion of said scraping member is arranged on an outer side of an outer end portion of said seal member.

11. A process cartridge according to claim 7, wherein said scraping member has a spatter preventing portion configured and positioned to suppress spattering of developer from the peripheral surface of said developing roller.

12. A process cartridge according to claim 11, wherein an angle made by a tangent at a position where said scraping member abuts said developing roller and said spatter preventing portion is an acute angle.

13. An image forming apparatus for forming an image on a recording medium, said image forming apparatus comprising:

(i) an electrophotographic photosensitive member;

(ii) a developing device comprising:

a developing roller configured and positioned to develop an electrostatic latent image formed on said electrophotographic photosensitive member;

a magnet provided on an inner side of said developing roller and having a plurality of local maximum magnetic flux density positions in each of which a magnetic flux density is a local maximum on a peripheral surface of said magnet;

a developing container supporting said developing roller;

a seal member provided at an end portion in an axial direction of said developing roller, configured and positioned to prevent a developer supplied to said developing roller from leaking out of said developing container in the axial direction of said developing roller;

a developer regulating member configured and positioned to regulate an amount of developer on the peripheral surface of said developing roller, said developer regulating member having an elastic portion abutting said developing roller and a supporting portion formed of a metal material and supporting said elastic portion; and a scraping member abutting said developing roller at an end portion in the axial direction of said developing roller, configured and positioned to collect the developer on the peripheral surface of said developing roller toward an inner side of said developing container in the axial direction, wherein, when said developing device is seen along the axial direction of said developing roller, said scraping member abuts said developing roller between a first position where the peripheral surface of said developing roller is crossed by a line which connects said supporting portion to the local maximum magnetic flux density position of the plurality of local maximum magnetic flux density positions that is nearest to said supporting portion, and a third position which is between the first position and a second position where said developing roller develops the electrostatic latent image and at which a line connecting a center of said developing roller and a local minimum magnetic flux density position crosses the peripheral surface of said developing roller, the local minimum magnetic flux density position being a position where the magnetic flux density is a minimum on the peripheral surface of said magnet; and (iii) conveying means for conveying the recording medium.

14. An image forming apparatus to which a process cartridge is detachably mountable for forming an image on a recording medium, said image forming apparatus comprising:

(i) mounting means for detachably mounting the process cartridge, the process cartridge comprising: an electrophotographic photosensitive member; a developing roller configured and positioned to develop an electrostatic latent image formed on the electrophotographic photosensitive member; a magnet provided on an inner side of the developing roller and having a plurality of local maximum magnetic flux density positions in each of which a magnetic flux density is a local maximum on a peripheral surface of the magnet; a developing container supporting the developing roller; a seal member provided at an end portion in an axial direction of the developing roller, configured and positioned to prevent a developer supplied to the developing roller from leaking out of the developing container in the axial direction of the developing roller; a developer regulating member configured and positioned to regulate an amount of developer on the peripheral surface of the developing roller, the developer regulating member having an elastic portion abutting the developing roller and a supporting portion formed of a metal material and supporting the elastic portion; and a scraping member abutting the developing roller at an end portion in the axial direction of the developing roller, configured and positioned to collect the developer on the peripheral surface of the developing roller toward an inner side of the developing container in the axial direction, wherein, when the process cartridge is seen along the axial direction of the developing roller, the scraping member abuts the developing roller between a first position where the peripheral surface of the developing roller is crossed by a line which connects the supporting portion to, the local maximum magnetic flux density position of the plurality of local maximum magnetic flux density positions that is nearest to the supporting portion, and a third position which is between the first position and a second position where said developing roller develops the electrostatic latent image and at which a line connecting a center of said developing roller and a local minimum magnetic flux density position crosses the peripheral surface of said developing roller, the local minimum magnetic flux density position being a position where the magnetic flux density is a minimum on the peripheral surface of said magnet; and (ii) conveying means for conveying the recording medium.

* * * * *

UNITED STATES PATENT AND TRADEMARK OFFICE

CERTIFICATE OF CORRECTION

PATENT NO. : 7,283,765 B2
APPLICATION NO. : 11/234157
DATED : October 16, 2007
INVENTOR(S) : Shunsuke Uratani et al.

It is certified that error appears in the above-identified patent and that said Letters Patent is hereby corrected as shown below:

ON THE TITLE PAGE

At item (56), References Cited, Foreign Patent Documents, "JP 2000089572 3/2000" should read --JP 2000-089572 3/2000--.

COLUMN 4

Line 26, "portion to the supporting portion," should read --portion,--.

COLUMN 17

Line 6, Claim 14, "to," should read --to--.

Signed and Sealed this

Seventeenth Day of February, 2009

JOHN DOLL
*Acting Director of the United States Patent and Trademark Office*